United States Patent [19]

Yang

[11] Patent Number: 4,625,951

[45] Date of Patent: Dec. 2, 1986

[54] WORKBENCH AND CLAMP STRUCTURE

[76] Inventor: Tai-Her Yang, 5-1 Taipin St., Si-Hu Town, Dzan-Hwa, Taiwan

[21] Appl. No.: 699,673

[22] Filed: Feb. 8, 1985

[51] Int. Cl.[4] ..... B25B 1/00

[52] U.S. Cl. ..... 269/88; 269/100; 269/251; 269/900; 269/901; 269/258

[58] Field of Search ..... 108/144, 148, 34, 130; 269/900, 88, 901, 283, 152, 258, 100, 97, 246, 251; 144/286, 286 A, 287; 248/188.2

[56] References Cited

U.S. PATENT DOCUMENTS

| | | | |
|---|---|---|---|
| 643,969 | 2/1900 | Milhe | 108/144 |
| 1,552,340 | 9/1925 | Paul | 144/286 R |
| 2,586,724 | 2/1952 | Sannebeck | 108/144 |
| 2,783,110 | 2/1957 | Helgeland | 108/130 |
| 4,157,819 | 6/1979 | Meyer | 269/900 |
| 4,199,135 | 4/1980 | Wohrle et al. | 269/901 |
| 4,415,149 | 11/1983 | Rees | 269/900 |
| 4,509,731 | 4/1985 | Schaal et al. | 269/900 |

*Primary Examiner*—Robert C. Watson
*Attorney, Agent, or Firm*—Leonard Bloom

[57] ABSTRACT

A work bench has folding U-shaped splayed legs received in sockets in respective spaced blocks. A horizontal work table is mounted on support posts carried by the blocks for vertical adjustment therein. The work table has a plurality of bosses formed integrally therewith and depending from the bottom surface thereof. Preferably, the bosses have through bores and are interconnected by respective ribs.

7 Claims, 70 Drawing Figures

1004
1101
1003
1002

1011

1006
1008
1007
1012
1005
1004
1001
1002

1009
1005
1002
1004
1009
1001

1006
1007
1001
1010
1009
1008
1005
1012
1004
1002

1006
1007
1001
1010
1005
1010
1009
1009
1004
1012

WORKBENCH AND CLAMP STRUCTURE

BACKGROUND OF THE INVENTION

This design has made reference to the following the U.S. Patents:

U.S. Pat. No. 2,322,380, U.S. Pat. No. 3,841,619, U.S. Pat. No. 4,022,454, U.S. Pat. No. 4,169,606, U.S. Pat. No. 4,155,386, U.S. Pat. No. 4,252,304, U.S. Pat. No. 4,330,113

(1) Of which, U.S. Pat. No. 2,322,380 has initiated the concept of the clamp work bench and particularly disclosed that its clamp side of the clamp claw has a longer structure and it has the following features:

Its 4 sets of clamp claws 9 constitute the clamps in 4 directions.

Its 4 sets of drive screws 18 drive the 4 sets of clamp claws said 9 (as shown in the drawing) radially driving toward the middle part;

Its two sets of clamp claws on the left side (as shown in the drawing) are commonly provided on the same motion jaw 12;

Its two sets of clamp claws on the right side (as shown in the drawing) are commonly provided on the same fixed jaw 10;

The guide screw 23 drives the motion jaw 12 making reciprocating movements along the guide rail 11 of said motion jaw 12.

Since various clamps drive separately and independently, this work bench has a very good agility to the practicability in clamping the work pieces. However, due to its structural limits, it still has the following defects:

The 4 sets of clamp claws are constantly in a constantly in a plane;

The horizontal plane of the work plane of the clamp claws is unadjustable;

None of the 4 sets of clamp claws is rotatable, so their adaptability to the irregular-shaped work pieces is poor.

(2) U.S. Pat. No. 3,841,619 has disclosed the two pieces of the opposite clamp claws 21, 22, that differ with those of the afore-said U.S. Pat. No. 2,322,380, that the guide screws on both sides make use of the preserved gap between the clamp plate and the guide nut to conduct the inclined clamp, and that it has a flat smooth clamp plate face which differs from the above-said U.S. Pat. No. 2,322,380.

(3) U.S. Pat. No. 4,022,454: Its design provides that the multi-row clamp plates on both sides clamp a work piece toward the central part. Although it has conveniences in its applications, it still has the defects as follows:

Its clamp plate 19 itself does not have any drive and clamp device;

The clamp does not have any self-swinging functions to meet the needs of the shapes of work pieces so its close contact to the work pieces is poor.

(4) U.S. Pat. No. 4,169,606 is the extended structure of U.S. Pat. No. 3,841,619.

(5) The applicant has closely noticed that U.S. Pat. Nos. 4,155,386 and 4,252,304 have disclosed through round holes are provided on the flat smooth clamp plate and the bottom has rotatable blocking block with a single round post to clamp the irregular-shaped work pieces.

(6) Furhter the applicant has also learned that the features of the U.S. Pat. No. 4,330,113 lies in that round hole 34 may be provided in the machine body 24 to accommodate the rotatable blocking block 106 and that the round post 127 is provided under said blocking block 106 and there is also a sidewise protruding structure 128.

But attention must be paid to the fact that the rotatable blocking blocks illustrated in the U.S. Pat. Nos. 4,155,386, 4,252,304, and 4,330,113 has a single leg and cannot be locked.

The main features of this design lie in:

holes or arc slots in different depths are regularly provided in the work bench;

a long coupling post and a short coupling post are provided at the bottom of the separately drivable clamp structure to couple the coupling holes in different depths in the work bench for options of a rotatable or locked form;

the attached auxiliary locking blocking block has two short coupling posts for locking;

each side of the work bench has a downwardly perpendicular bent plane and coupling holes in different depths;

the said downwardly perpendicular planes on the sides of the work bench are foldable;

furhter the slots in different depths in the work bench are in a ring shape.

With the above-said structure, the work bench has the following merits:

the separate clamp structure and the long rounds coupling post and the short round coupling post provided at the bottom of the auxiliary motion blocking block, and the regular holes or slots in different depths in the work bench response to the shapes of the work pieces and couple the work pieces with long legs thus making the short legs suspending and rotatable status without any contact or with the long legs coupled in the deep holes and the short legs coupled in the shallow holes, hereby forming a locked status, and the driving of the clamp claws on the separate clamp structure clamps and locks a work piece;

Optional rotatable or locking auxiliary motion blocking blocks are provided and the blocking blocks for the exclusive blocking purpose are also provided to enhance the work agility.

Or several sets of regularly arranged round holes are provided in the work bench, the base seat of the separate clamp structure has a central round post to couple the above-said round hole for rotatable adjustments, a stabilization screw pin that can adjusted up and down is provided on said base seat for downward operations, thus making said pin coupled to the round hole in the work bench, to make said base seat unrotatable, is for upward movements, hereby making said basic seat rotatable around said central round post. Based on the above description, this application is a practical design.

SUMMARY OF THE INVENTION

This design is to provide a simple and convenient clamping method for the irregular-shaped work pieces, mainly structured in a manner that holes or slots in different depths are provided on the work bench to match the coupling posts in different unequal lengths provided on the bottom of the separate clamp structure in order to select the separate clamp structure in a rotatable or firmly locked form, or that several sets of round holes are provided in said work bench, and the base seat of the separate clamp structure has a round coupling post as the rotary center and also an adjustable stabilization post to be adaptable to clamping various kinds of work pieces.

BRIEF DESCRIPTION OF THE DRAWINGS

FIG. 1-1 is the top view of an example of the utilization of the rotatable or positioning single clamp claw-type clamp.

FIG. 1-2 is the front view of an example of the utilization of the rotatable or positioning single clamp claw-type clamp.

FIG. 1-3 is the side cross sectional view of an example of the utilization of the rotatable or positioning single clamp claw-type clamp.

FIG. 1-4 is an exalple of the design of the central post (having a fixing nut) of the clamp shown in FIG. 1.

FIG. 1-5 is an example of the desing of the positioning pin.

FIG. 2 is the view of an example of the utilization of the rotatable or positioning single piece-type clamp with semi-moon-shaped motion clamp claws.

FIG. 2-1 is the top view of an example of the utilization of the ratatable or positioning single piece-type clamp with semi-moon-shaped motion clamp claws.

FIG. 2-2 is the front view of an example of the utilization of the rotatable or positioning single piece-type clamp with semi-moon-shaped motion clamp claws.

FIG. 2-3 is the side cross sectional view of an example of the utilization of the rotatable or positioning single piece-type clamp with semi-moon-shaped motion clamp claws.

FIG. 3 is the view of the utilization of the utilization of the work bench which can conduct a 3-dimensional clamp and has an anvil to modify the forms of work pieces.

FIG. 3-1 is the top view of the utilization of the utilization of the work bench which can conduct a 3-dimensional clamp and has an anvil to modify the forms of work pieces.

FIG. 3-2 is the left side view of the utilization of the work bench which can conduct a 3-dimensional clamp and has an anvil to modify the forms of work pieces.

FIG. 3-3 is the front view of the utilization of the work bench which can conduct a 3-dimensional clamp and has an anvil to modify the forms of work pieces.

FIG. 3-4 is the back view of the utilization of the utilization of the work bench which can conduct a 3-dimensional clamp and has an anvil to modify the forms of work pieces.

FIG. 3-5 is the bottom view of the utilization of the utilization of the work bench which can conduct a 3-dimensional clamp and has an anvil to modify the forms of work pieces.

FIG. 3-6 is the rights side view of the utilization of the work bench which can conduct a 3-dimensional clamp and has an anvil to modify the forms of work pieces.

FIG. 3-7 is the view of an example of the utilization of the bench top up-and-down adjustments for example of the utilization shown in FIG. 3.

FIG. 3-8 is the view of an example of the utilization of clamping a ring-shaped work piece by stretching outwardly from within for the example of utilization shown in FIG. 3.

FIG. 3-9 is the view of an example of the utilization of clamping, by its sides, a work piece standing on a floor for the example of the utilization shown in FIG. 3.

FIG. 3-10 is the view of an example of the utilization of clamping a round work piece for the example of the utilization shown in FIG. 3.

FIG. 3-11 is the view of an example of the utilization of clamping a parallel work piece for the example of the utilization shown in FIG. 3.

FIG. 3-12 is the view of an wxample of the utilization of hammering and modifying the work pieces in their forms for an example of the utilization shown in FIG. 3.

FIG. 4 is the top view of an example of the utilization of the single set of round post-shaped clamp.

FIG. 4-1 is the side cross sectional view of an example of the utilization of the single set of round post-shaped clamps.

FIG. 5 is the top view of the single post-type single-piece clamp claw clamp.

FIG. 5-1 is the cross sectional view of the single post-type single-piece clamp claw clamp.

FIG. 5-2 is the front view of the single post-type single-piece clamp claw clamp.

FIG. 6 is the top view of the single post-type block-shaped blocking blocks.

FIG. 6-1 is the side view of the single post-type block-shaped blocking blocks.

FIG. 7 is the top view of the two-post-type fixed blocking blocks.

FIG. 7-1 is the side view of the two-post-type fixed blocking blocks.

FIG. 8 is 3-dimensional the view of an example of the utilization of fixed blocking blocks with selective distances between the support posts.

FIG. 8-1 is the top view of an example of the utilization of fixed blocking blocks with selective distances between the support posts.

FIG. 8-2 is the side view of an example of the utilization of fixed blocking blocks with selective distances between the support posts.

FIG. 9 is the top view of the two-post-type blocking blocks having two sets of motion clamp claws.

FIG. 9-1 is the front view of the two-post-type blocking blocks having two sets of motion clamp claws.

FIG. 9-2 is the side view of the two-post-type blocking blocks having two sets of motion clamp claws.

FIG. 10 is the view of an example of the utilization of the flat plate-type multi-set regular coupling holes work bench.

FIG. 10-1 is the top view of an example of the utilization of the flat plate-type multi-set regular coupling holes work bench.

FIG. 10-2 is the cross sectional view of an example of the utilization of the flat plate-type multi-set regular coupling holes work bench.

FIG. 11 is the view of an example of the utilization of the ⌐-shaped multi-set regular compling holes work bench.

FIG. 11-1 is the side view of an example of the utilization of the ⌐-shaped multi-set regular coupling holes work bench.

FIG. 11-2 is the top view of an example of the utilization of the ⌐-shaped multi-set regular coupling holes work bench.

FIG. 11-3 is the corss sectional view of an example of the utilization of the ⌐-shaped multi-set regular coupling holes work bench.

FIG. 12 is the view of an example of the corner-bendable-and-foldable work bench.

FIG. 12-1 is the top view of an example of the corner-bendable-and-foldable work bench.

FIG. 12-2 is the side cross sectional view of an example of the corner-bendable-and-foldable work bench.

FIG. 12-3 is the side view of an example of the corner-bendable-and-foldable work bench.

FIG. 13-1 is the top view of an example of the utilization of the single clamp claw-type clamp having a rotatable central post and a positioning post.

FIG. 13-2 is the front view of an example of the single clamp claw-type clamp having a rotatable central post and a positioning post.

FIG. 13-3 is the cross sectional view of an example of the utilization of the single clamp claw-type clamp having a rotatable central post and a positioning post.

FIG. 14-1 is the top view of the utilization of the clamp having a rotatable central post and a positioning post.

FIG. 14-2 is the front view of the utilization of the clamp having a rotatable central post and a positioning post.

FIG. 14-3 is the side cross sectional view of the utilization of the clamp having a rotatable central post and a positioning post.

FIG. 15-1 is the top view of the utilization of the work bench having rotatable holes and positioning holes.

FIG. 15-2 is the side cross sectional view of the utilization of the work bench having rotatable holes and positioning holes.

FIG. 16-1 is the side cross sectional view of an example of the utilization of the work bench having ring-shaped coupling slots.

FIG. 17-1 is the side cross sectional view of an example of the utilization of the work bench having dovetail-type ring-shaped coupling slots.

FIG. 18-1 is the side cross sectional view of an example of the utilization of the work bench having T-slot-type ring-shaped coupling slots.

FIG. 19-1 is the side cross sectional view of an example of the utilization of the work bench having multi-ring-shaped coupling slots.

FIG. 20-1 is the side cross sectional view of an example of the utilization of the positioning work bench having multi-ring-shaped slots in different depths.

Parts Description:

1001: clamp base seat (base seat of the clamp)
1002: central post
1003: threads at the central end
1004: motion clamp claw
1005: guides screw
1006: handle
1007: clamp support arm (support arm of the clamp)
1008: screw hole of the support arm
1009: screw hole A of the positioning pin
1010: screw hole B of the positioning pin
1011: positioning pin
1012: pisitioning pin of the guide screw
1021: motion jaw with arc socket
1022: semi-moon-shaped clamp claw
1101: work bench
1102: round hole
1103: connection block
1104: support post
1106: turning screw with nut
1107: foot rack
1108: support plate of the foot rack
1110: coupling through hole of the support post
1111: join screw of the support post
1201: the proper of the cylindrical clamp
1202: sidewise screw hole
1203: handle
1204: swinging clamp block
1205: ball-shaped jaw
1210: threads
1211: rotatable coupling post
1212: proper of the clamp
1213: block-shaped blocking block
1240: fixed blocking block
1241: support leg of the clamp block
1242: V-shaped slot
1243: fixed blocking block with selective intervals
1244: adjustment pin hole
1245: fixed pin
1246: blocking block having two sets of arc sockets
1301: flat-plate-shaped work bench
1302: ⊓-shaped work bench
1303: corner (angle)-bendable-and-foldable work bench
1304: join block with staggered coupling holes
1305: through post
1306: support arm
1307: fixing screw of the support arm
1308: adjustment slot of the support arm
1401: clamp base seat
1402: positioning post
1501: positioning blind hole
1601: base seat
1602: ring-shaped slot
1603: motion jaw
1604: slide clamp claw
1901: base seat
1702: dovetail-type ring-shaped slot
1703: conic coupling block
1704: screw
1705: rotatable clamp jaw
1801: base seat
1802: ring-shaped T-slot
1803: insertion inlet
1804: rabbeting slide block
1901: base seat
1902: ring-shaped slot
2001: base seat

2002: ring-shaped deep slot
2003: ring-shaped positioning shallow slot

DETAILED DESCRIPTION OF THE INVENTION

The object of the improved design of the present invention is to provide an easily operable and rugged work bench to make a stable clamp for metal and wood products for processing or checks and repair.

Figures 1, 2, 3, 4, 5:
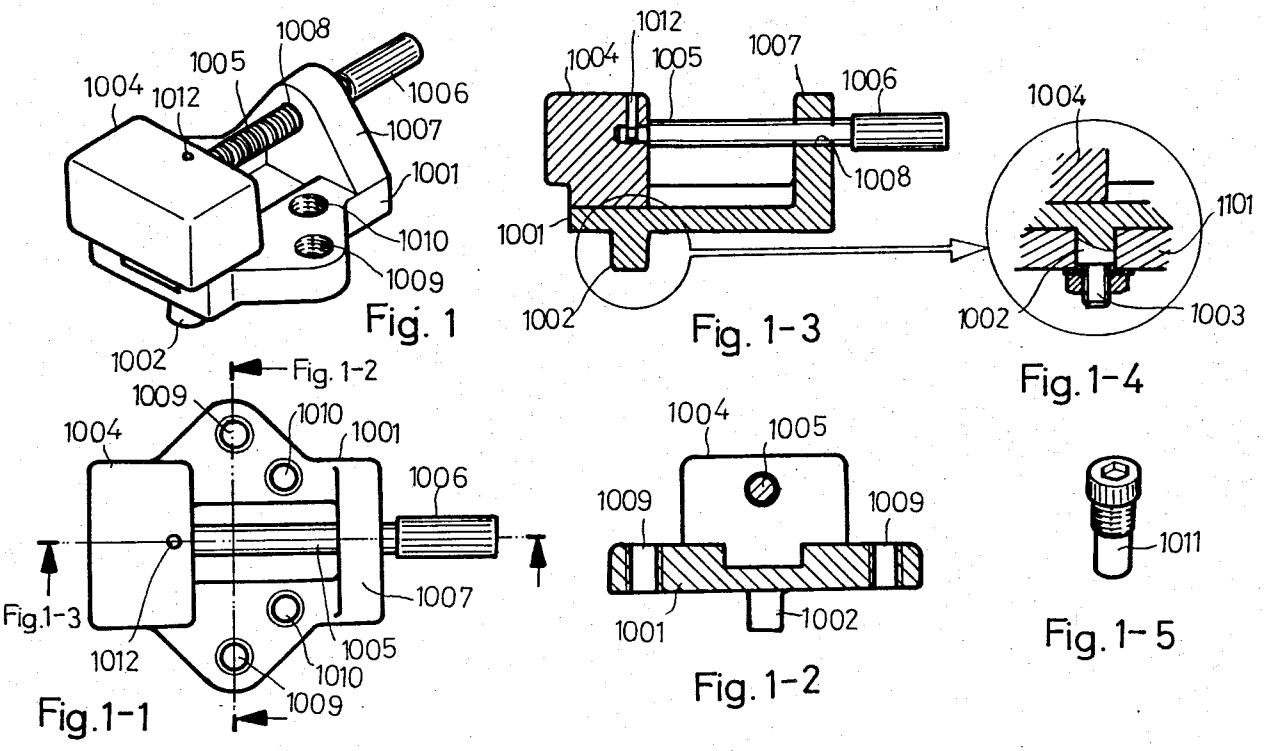
Figures 2, 3:
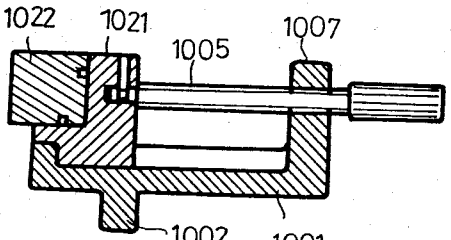
Figure 2:
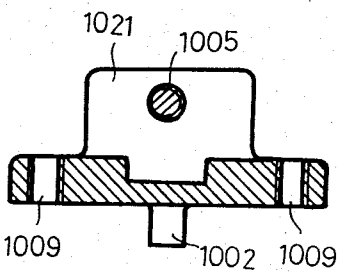
Figure 2:
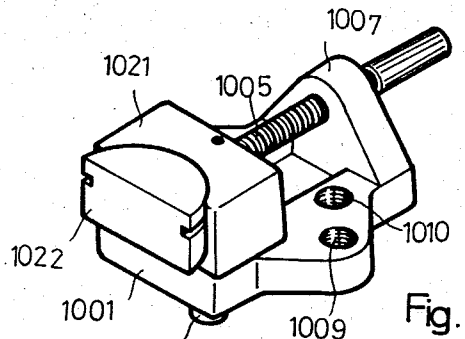
Figures 1, 2:
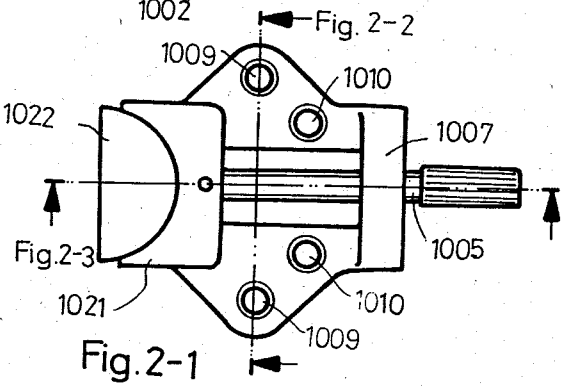

As the work assembly shown in FIGS. 1 and 1-1, 1-2, 1-3, 1-4, and 1-5, and FIGS. 3 and 3-1, 3-2, 3-3, 3-4, 3-5, and 3-6, a work bench capable of clamping the irregular-shaped work pieces is thus constituted. Of which, FIG. 1 is the view of the example of the utilization of the rotatable or positioning single clamp claw-type clamp.

FIG. 1-1 is the top view of the example of the utilization of the rotatable or positioning single clamp claw-type clamp.

FIG. 1-2 is the front view of the example of the utilization of the rotatable or positioning single clamp claw-type clamp.

FIG. 1-3 is the side cross sectional view of the example of the utilization of the rotatable or positioning single clamp claw-type clamp.

FIG. 1-4 is the example of the design of the central post (having a fixed nut) of the clamp shown in FIG. 1.

FIG. 1-5 is the example of the positioning pin.

FIG. 3 is the view of the example of the work bench that can make a 3-dimensional clamp and has an anvil head to modify the forms of work pieces.

In FIG. 1, the central post 1002 under the base seat of the clamp is used as a rotary center, a motion clamp jaw 1004 is provided on the front rim of clamp base seat 1oo1: to accept the clamping and releasing actions of the driving by the guide screw 1005 in the screw hole 1008 of the support arm on the clamp support arm 1027, and screw holes A 1009 and B 1010 are provided on both sides of said clamp base seat 1001 to accommodate positioning pin 1011 to be screwed herein. Features and functions of this structure are as follows:

when this clamp is set in the round hole 1102 as shown in FIG. 3, if the positioning pin is screwed not through the base seat, the clamp can be a rotated in directional adjustments with the central post 1002 as its center of rotation; when the positioning pin 1011 is screwed through the central post 1002, the clamp is positioned;

the positioning screw holes 1009 and 1010 are to selecting couple the different hole distances formed by various round holes 1102 shown in FIG. 3;

the end of above-said positioning pin 1011 is the form of round post in a samll diameter to couple the round hole 1102, and the middle section of said round hole 1102 has threads in a longer diameter to screw in the screw hole 1009 or 1010 of the positioning pin;

the above-said central post 1002 may further have its middle part to be coupled to the screw hole 1009 or 1010 in the positioning pin for rotatable movements, and its and has thread teeth in a smaller diameter to be screwed on a nut.

FIG. 2 is the view of an example of the utilization of the semi-moon-shaped motion clamp claw rotatable or positioning single-piece type clamp. This is the clamp structure in FIG. 1 that further has a arc-socket motion jaw 1021 and semi-moon clamp claws to form a clamp form that is adjustable in angles along with the work pieces to further replace the motion clamp jaw 1004 in FIG. 1 so as to improve the applicatory scope of the clamp FIG. 2-1 is its top view, FIG. 2-2 is its front view; FIG. 2-3 is its side cross sectional view.

The structure in FIG. 3 mainly has several sets of work benches with round holes 1102 and the connection blocks 1103, the support post 1104 is used for joining them by proper up-and-down adjustments, while the foot rack 1107 can swing the joined to join the connection block 1103.

The features of its structure are as follows:

its middle work bench is in a ⌐ form, having a work plane and a perpendicular side plane, while a number of round holes are provided in regular arrays in said work plane and side plane;

both ends of the bent angle has a ball-shaped protruding anvil for processing and modifying the forms by hammering respectively;

the closer two sides have screw holes to accommodate the support post 1104 to be screwed and joined herein;

the connection block is in a L-shape, its horizontal plane has a round hole 1110 for the support post 1104 to slide therein, and the screw 1106 with a nut is screwed on or unscrewed thereon for release and locking, its perpendicular plane has a round hole to join, by the foot rack, the screw 1111 to swing the joint for through motion joint;

one end of the swinging joint is in a elliptic flat form, its center has a round to pass through the connection screw 1111 of the foot rack, while its other end is a hollow cylindrical form and has threads to be screwed on the foot rack 167 tightly;

two sets of the foot racks 1107 are in a U form, their ends have threads to be screwed on a swinging joint respectively; and a foldable support post is provided between said two sets.

After the above structure makes the machine body joined, it can be movable folded up, for easy packing and storage.

FIG. 3-1 is the top view of an example of the utilization of the work bench for 3-dimensional clamps and having an anvil for modifying the forms of work pieces.

FIG. 3-2 is the left side view of an example of the utilization of the work bench for 3-dimensional clamps and having an anvil for modifying the forms of work pieces.

FIG. 3-3 is the front view of an example of the utilization of the work bench for 3-dimensional clamps and having an anvil for modifying the forms of work pieces.

FIG. 3-4 is the back view of an example of the utilization of the work bench for 3-dimensional clamps and having an anvil for modifying the forms of work pieces.

FIG. 3-5 is the bottom view of an example of the utilization of the work bench for 3-dimensional clamps and having an anvil for modifying the forms of work pieces.

FIG. 3-6 is the right side view of an example of the utilization of the work bench for 3-dimensional clamps and having an anvil for modifying the forms of work pieces.

FIG. 3-7 is the view of an example of the utilization of the up-and-down adjustments of the bench top for the example of the utilization in FIG. 3.

FIG. 3-8 is the view of an example of the utilization of clamping a ring-shaped article by stretching outwardly from the inside for the example of the utilization in FIG. 3.

FIG. 3-9 is the view of an example of the utilization of clamping a work piece standing on the floor by its side for example of the utilization in FIG. 3.

FIG. 3-10 is the view of an example of the utilization of clamping a round work piece for the example of the utilization in FIG. 3.

FIG. 3-11 is the view of an example of the utilization of parally clamping a work piece for the example of the utilization in FIG. 3.

FIG. 3-12 is the view of an example of the utilization of the hammering the work pieces and modifying their forms for the example of utilization in FIG. 3.

Figure 3:
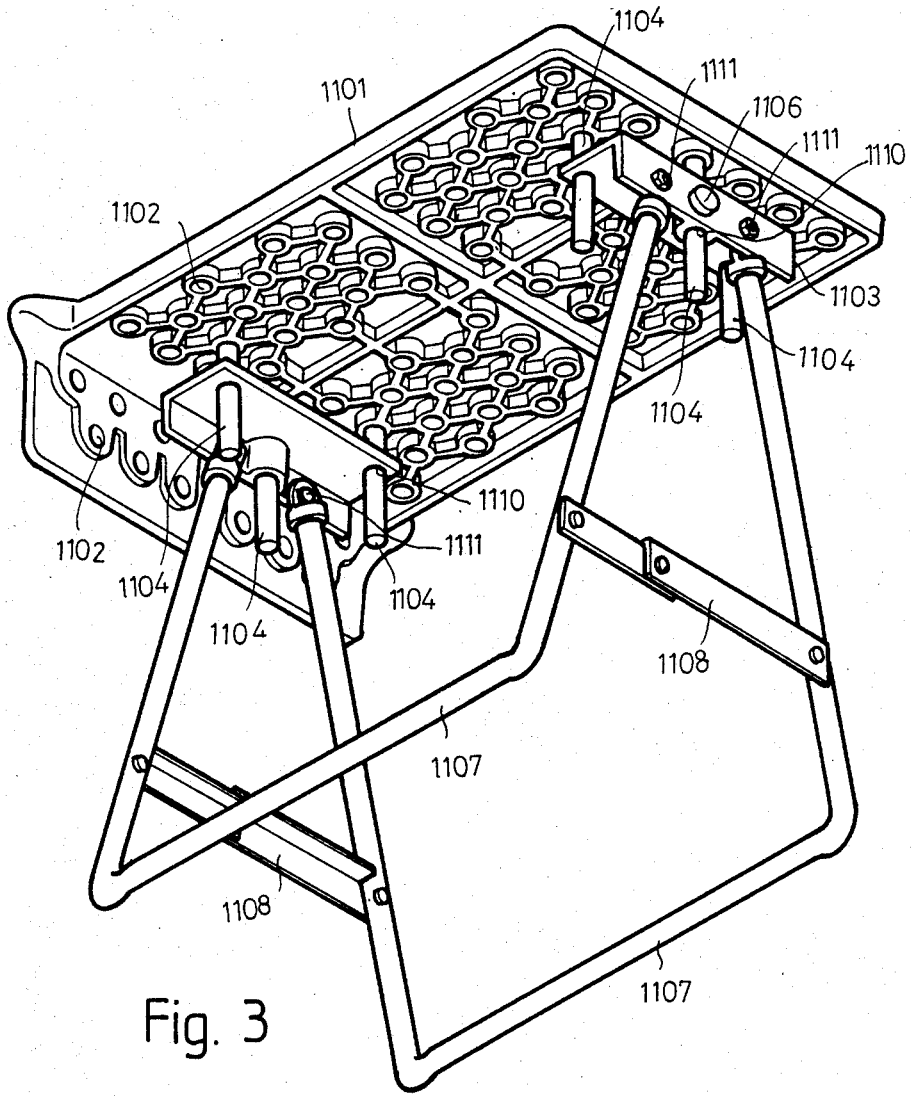
Figures 1, 3:
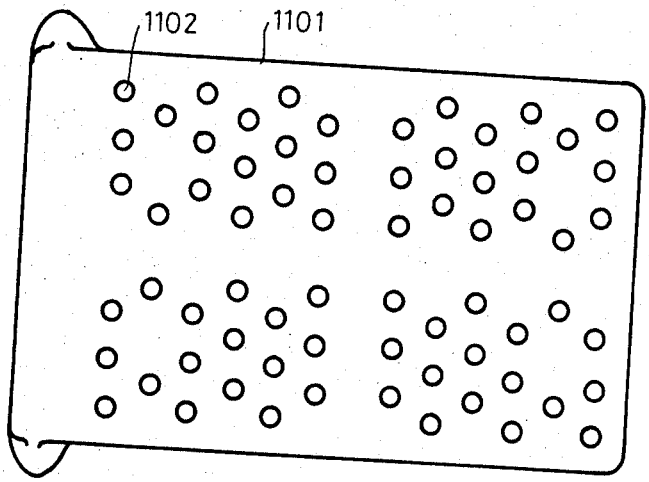
Figures 2, 3:
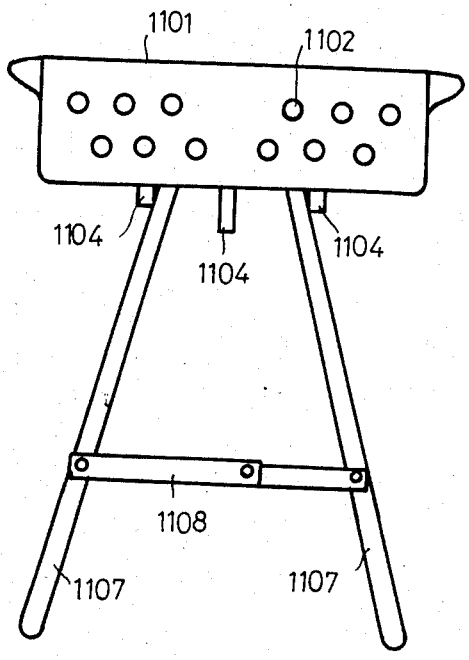
Figure 3:
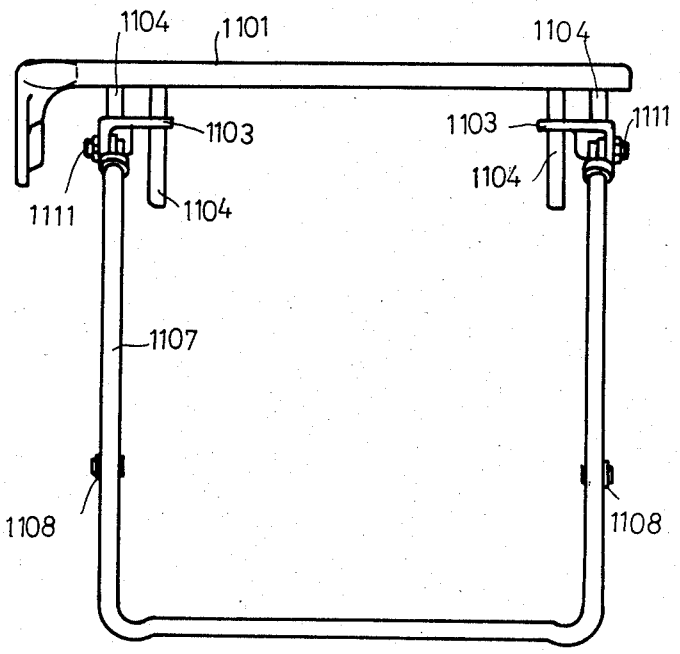
Figures 3, 4:
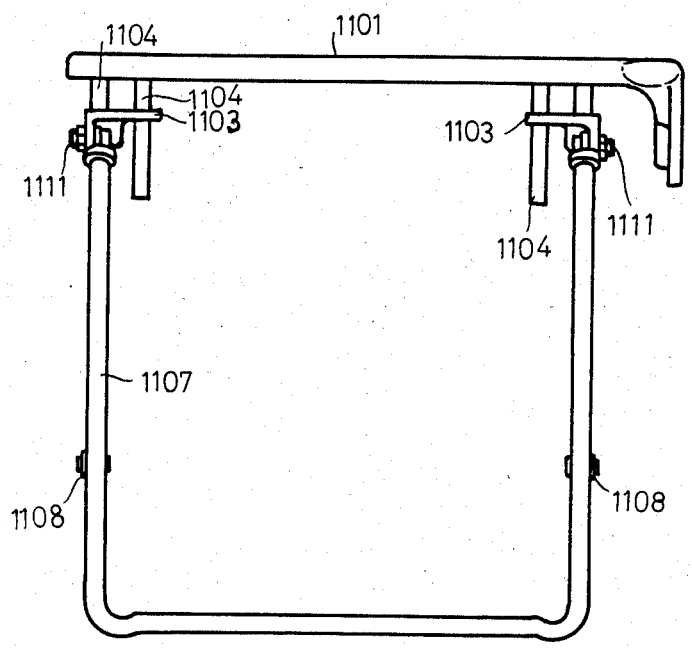
Figures 3, 4, 5:
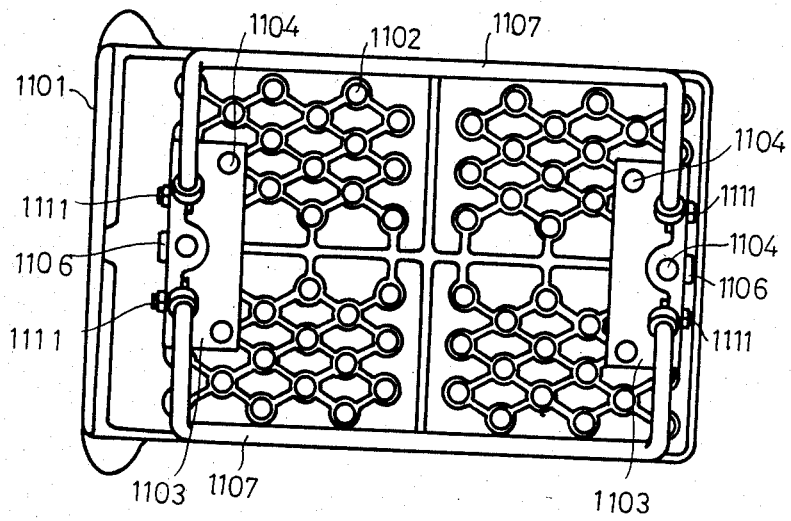
Figures 3, 4, 5, 6:
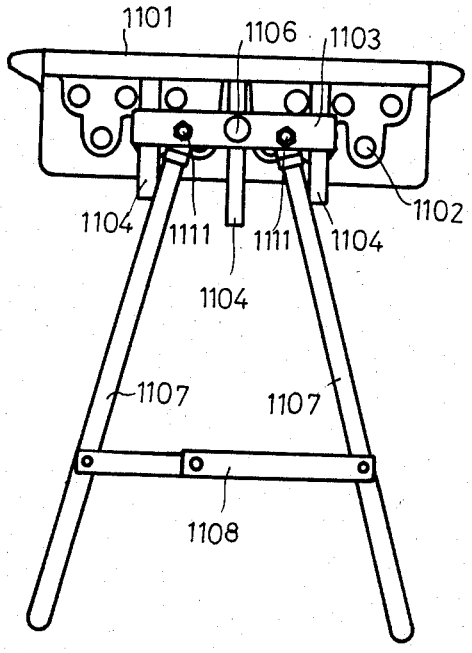

Besides, FIG. 3 the clamp blocks attached to the above said work bench in FIG. 3 for clamping can further be in a single-post-shaped rotatable clamp structure as shown in FIGS. 4, 5, & 6.

As shown in FIG. 4 is the view of an example of the utilization of the single set round post-shaped clamp, the structure of which is:

the proper 1201 of the round post-shaped clamp has a sidewise screw hole 1202 and its foot (leg) part is in a parallel round-post shape, while its end has threads in a smaller diameter;

the guide screw horizontally passes through the above-said sidewise screw hole 1202, its one end has a handle and its other end is in a ball-shaped jaw 1205 which engages the swinging clamp block 1204, thus forming a rotatable clamp.

FIG. 4-1 is its side cross sectional view.

FIG. 5 is the top view of the single-post-type single piece clamp claw clamp, a structure similar to that of the clamp shown in FIG. 1, whereas its different features lie in that it only has a single parallel round post-shaped leg(foot); the end of its leg has threads in a smaller diameter to pass through the round holes 1102 in the bench top shown in FIG. 3 and then is screwed into a nut; FIG. 5-1 is its side cross sectional view; FIG. 5-2 is its front view.

FIG. 6 is the top view of the single post-shaped blocking blocks which are economic and sinple auxiliary blocking blocks to match the above-said clamp structure having a drive guide posts as shown in FIGS. 1, 2, 4, & 5, to clamp a work piece; FIG. 6-1 is its side view.

Figures 3, 4, 5, 6, 7:
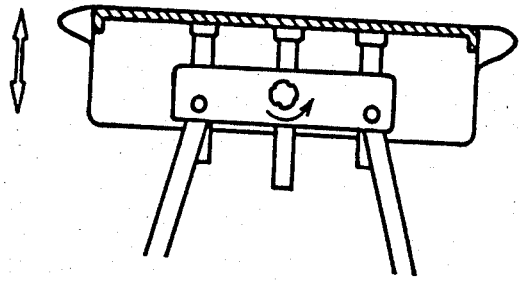

FIG. 7 is the top view of the two-post type fixed blocking blocks, their structure has two parallel post-shaped support legs 1241 mutually at a fixed distance between them to be inserted into the round holes 1102 in the work bench top; FIG. 7-1 is its side view.

Figures 3, 4, 5, 6, 7, 8, 9, 10, 11, 12:
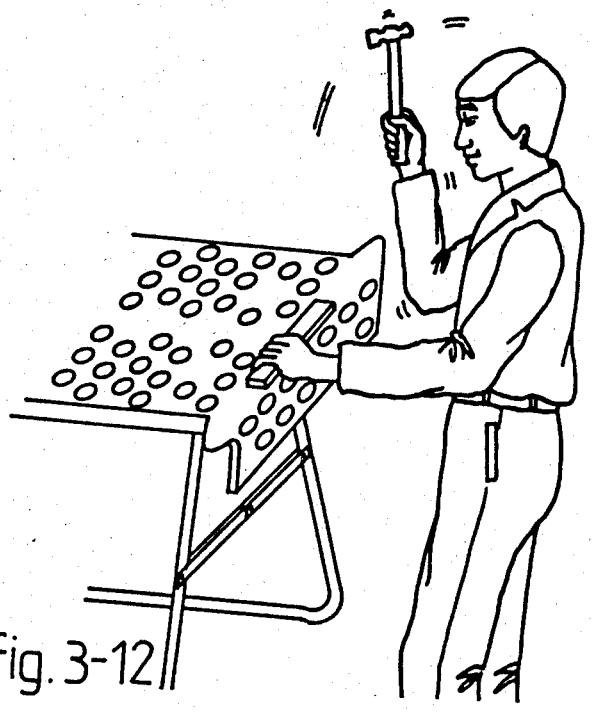
Figures 3, 4, 5, 6, 7, 8:
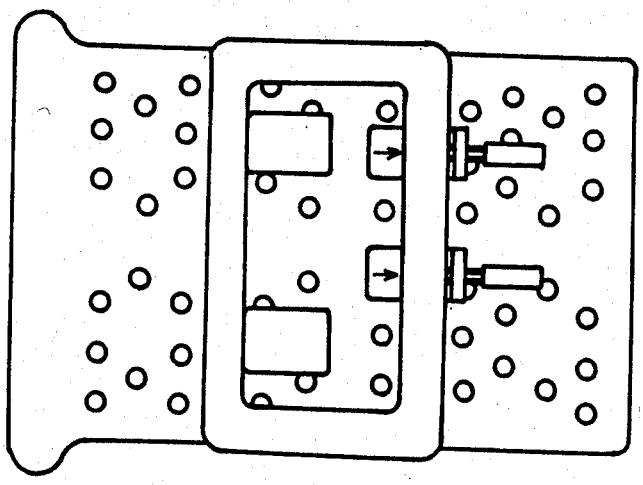
Figures 3, 4, 5, 6, 7, 8, 9:
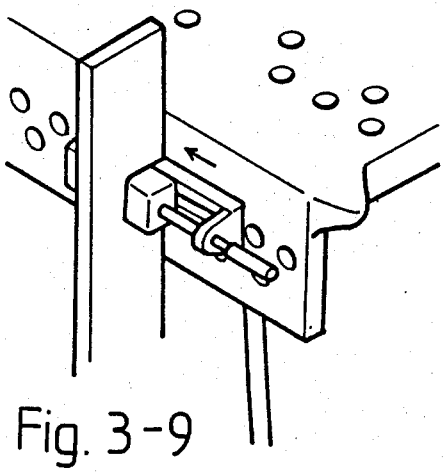
Figures 3, 4, 5, 6, 7, 8, 9, 10:
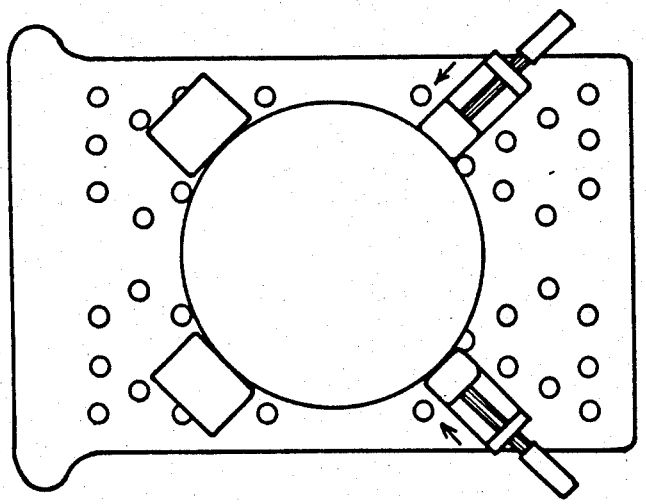
Figures 3, 4, 5, 6, 7, 8, 9, 10, 11:
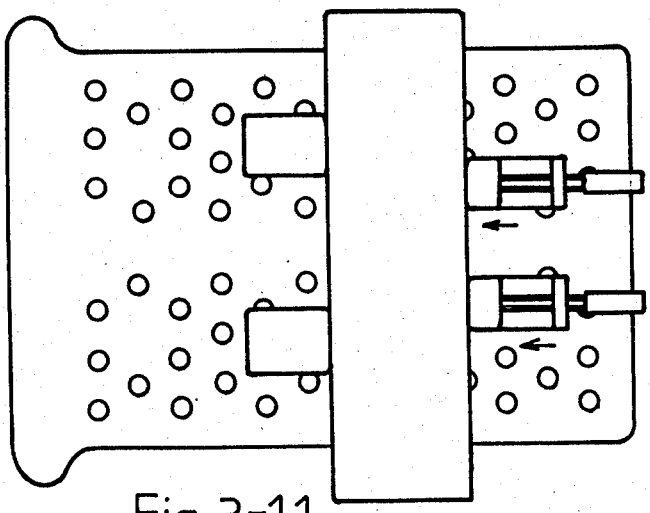
Figure 4:
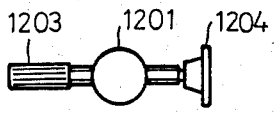
Figure 6:
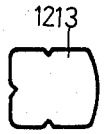
Figures 1, 4:
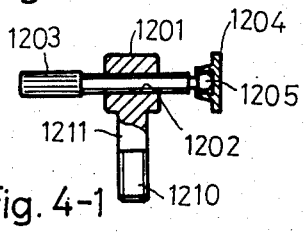
Figures 1, 6:
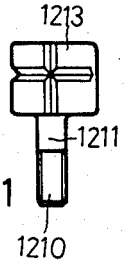
Figure 5:
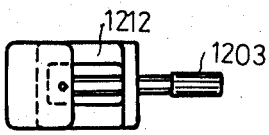
Figures 1, 5:
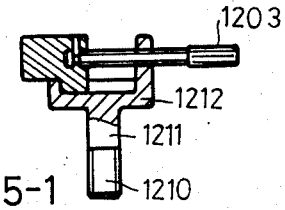
Figures 2, 5:
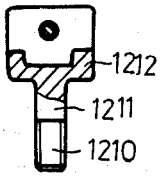
Figure 7:
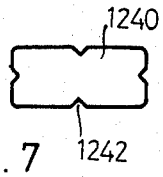
Figures 1, 7:
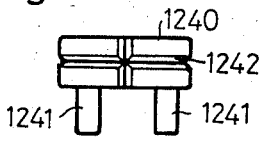
Figure 8:
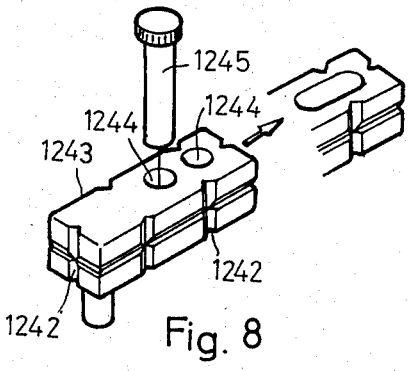
Figures 1, 8:
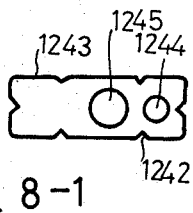
Figure 9:
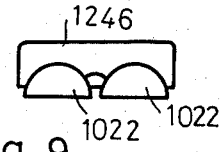
Figures 2, 8:
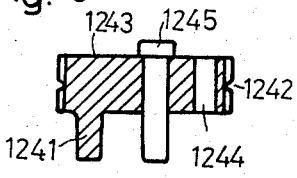
Figures 1, 9:
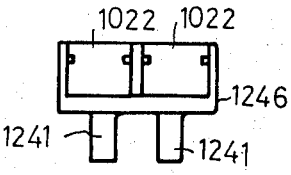
Figures 2, 9:
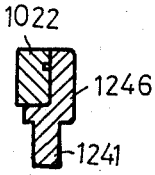
Figure 10:
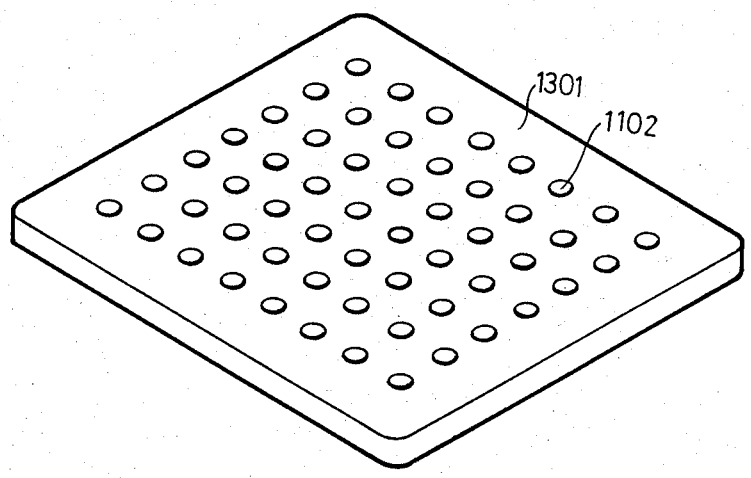
Figures 1, 10:
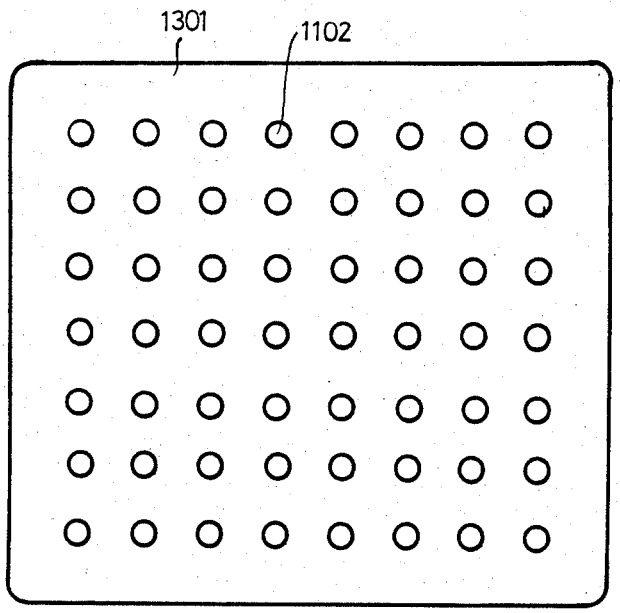
Figures 2, 10:
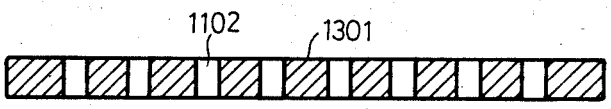
Figure 11:
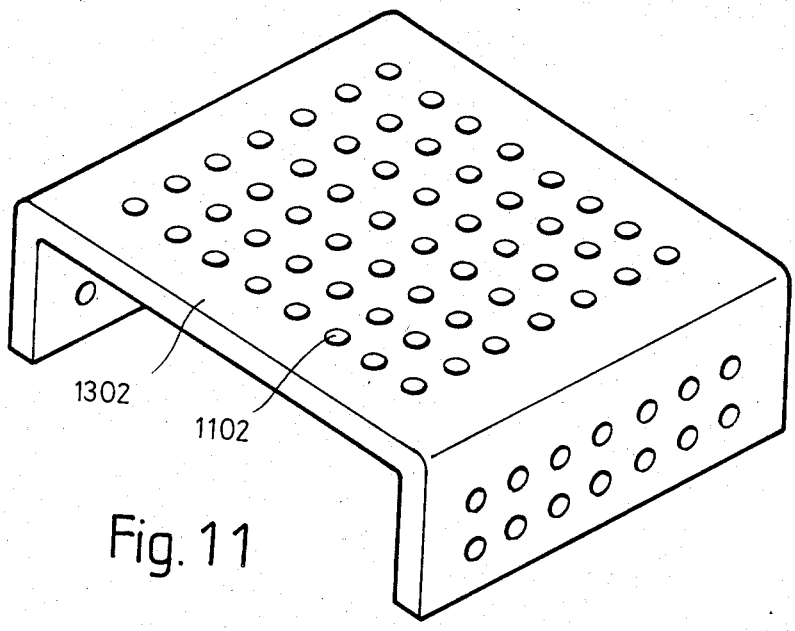
Figures 1, 11:
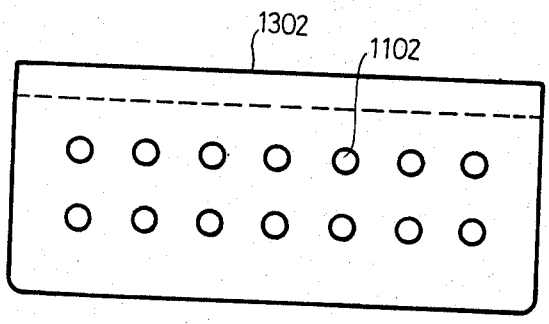
Figures 2, 11:
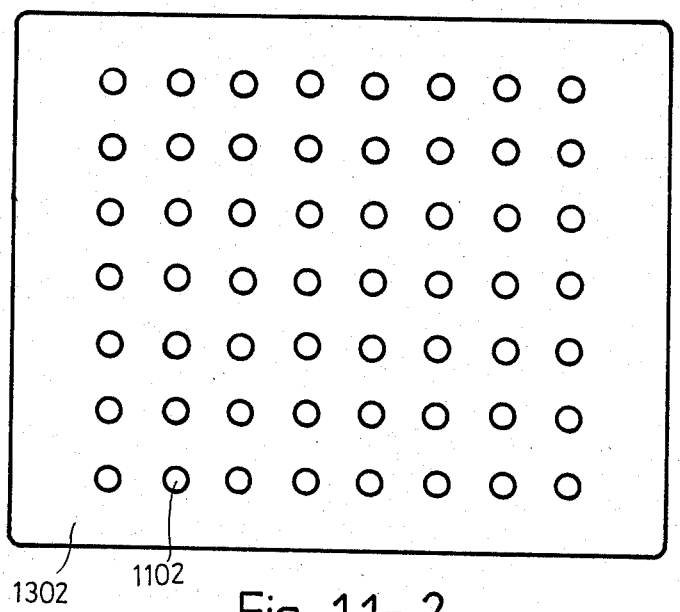
Figures 3, 11:
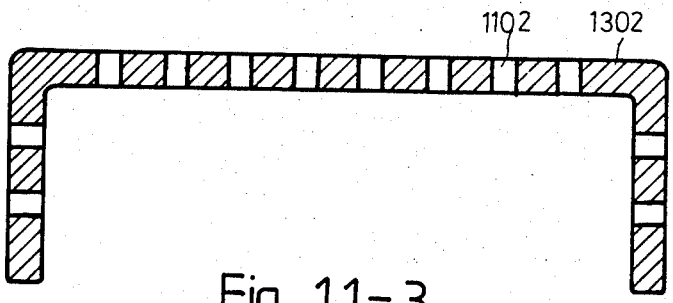
Figure 12:
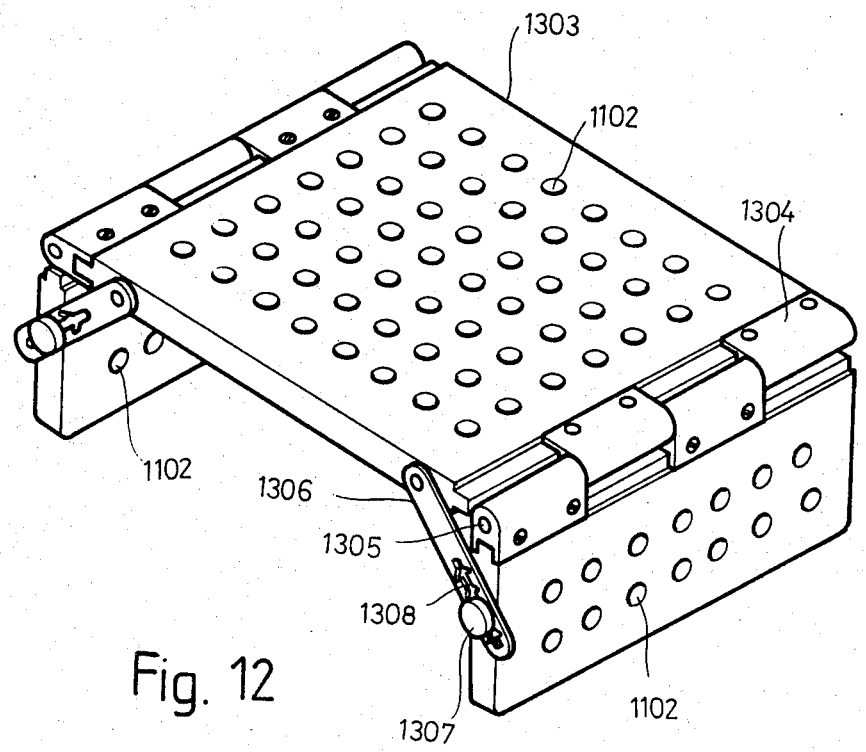
Figures 1, 12:
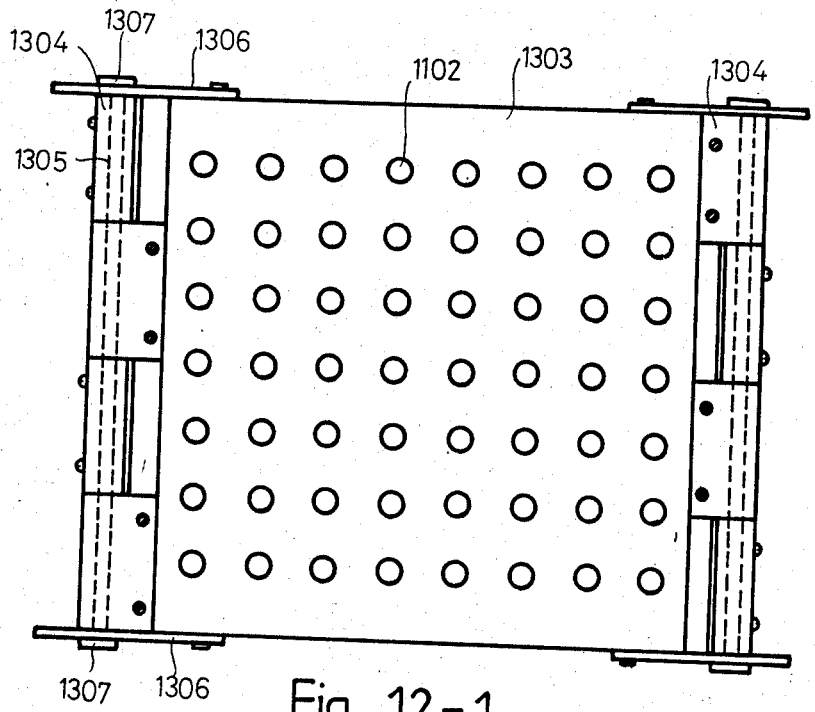
Figures 2, 12:
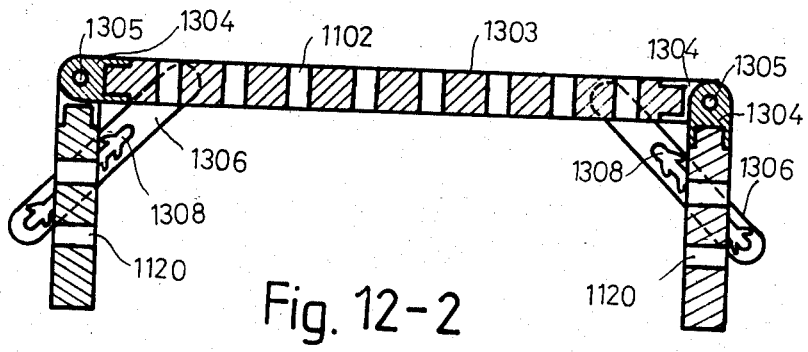
Figures 3, 12:
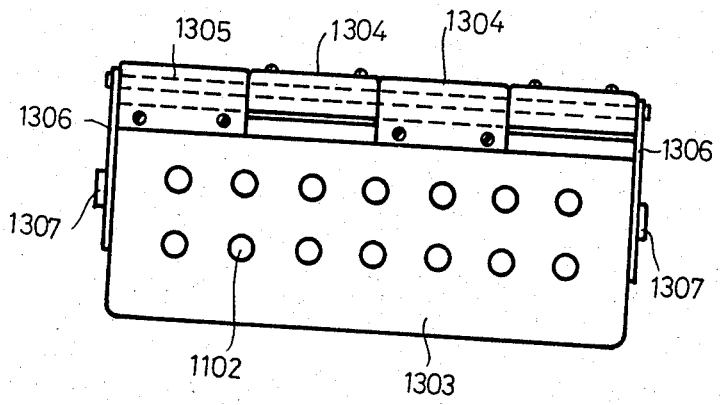

FIG. 8 is the view of an example of the utilization of the fixed blocking blocks for which the distance between the support posts can be selected and this is the improved structure of that shown in FIG. 7 and its features are:

that it has fixed parallel post-shaped legs parts which have at least more than two of the adjustment pin holes 1244 in different intervals distances to those on the fixed legs to accommodate the fixed pin 1245; or a parallel slot replaces the above-said several sets of round holes suitable for the V-shaped slots 1242 to be adjustably coupled on the work bench to meet the different hole intervals resulted by the adjustments in the directions.

FIG. 8-1 is its top view; FIG. 8-2 is its side view.

FIG. 9 is the top view of the two-post-type blocking blocks having two sets of motion clamp claws, it is the example of the utilization of the join of the sets of the blocking block 1246 having two sets of semi-moon-shaped clamp claw 1022 and having two sets of arc sockets and also having two parallel round post-shaped support legs 1241 in a fixed distance between them.

FIG. 9-1 is its front view; FIG. 9-2 is its side view.

Besides, the ⌐-shaped work bench as shown in above FIG. 3 is only an example of the utilization, and it can further be a simple plane-type-structure.

FIG. 10 is the view of an example of the utilization of the flat plate-type multi-set regular coupling holes work bench;

FIG. 10-1 is its top view. FIG. 10-2 is its top view.

Or from FIG. 11, it is the view of an example of the utilization of ⌐-shaped multi-set regular coupling holes work bench to clamp, by its both sides, a large-sized work piece standing on the floor.

FIG. 11-1 is its side view; FIG. 11-2 is its top view; FIG. 11-3 is its side cross sectional view.

Other numerous similar structures which are too many to mention here are now omitted without any more elaborations.

FIG. 12 is the view of an example of utilization of the work bench top with foldable and bendable corners (angles), which is improved from what is shown in above FIG. 11 to become a structure with foldable and bendable corners (angles), its feature lie in that the horizontal plane surface and the two perpendicular planes in a staggered join, and has a through post 1305, the middle part of which an arm support fixing screw 1307, passes through for corner folding and bending adjustments, both ends of the support arm are respectively fixed on the horizontal plane face and the place between the two perpendicular plane faces, a support-arm adjustment slot 1308 is provided in its middle part for setting various bend corner (angle) positions by the fixed screw 1307.

Besides, the join structure between the above-said horizontal place face and the perpendicular plane face can also be replaced by the hinge commonly used by the doors, with its functions in a way that a proper bent angle can be adjusted according to the work needs to fit the work pieces as its features.

FIG. 12-1 is its top view; FIG. 12-2 is its side corss sectional view; FIG. 12-3 is its side view.

The above-said angle-foldable structure can also be suitable for the ⌐-shaped structure in FIG. 3, and its structural principle is just the same.

Additionally, the positioning and rotatable structure of the above-stated clamp structure further employes the holes in different depths provided on the work bench and the support legs in different lengths provided on the bottom of the clamp base seat to couple by side long legs, with shallow holes, thus making the short support legs suspended in the air and the clamp in a swinging status, and, by said short legs, with said deep holes, and, by said short support legs, with said shallow holes, hereby making the clamp in a status of fixed position without any swing for the operator's selections.

Figures 3, 13:
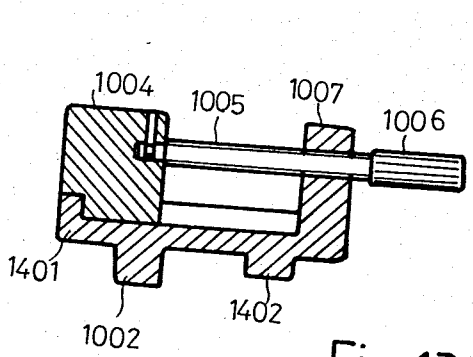
Figures 2, 13:
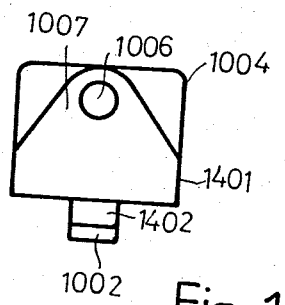
Figure 13:
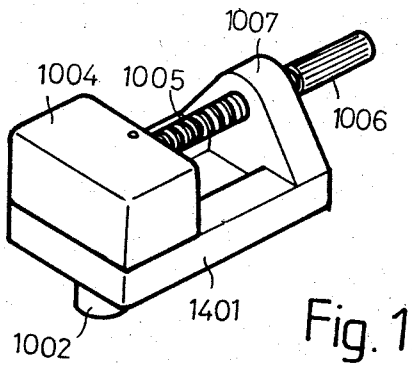
FIG. 13 is the view of an example of the utilization of the single clamp claw-type clamp having a rotatable central post and a positioning post.
Figures 1, 13:
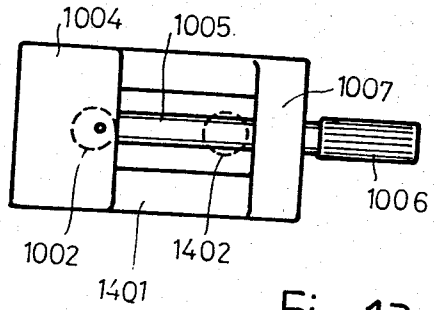
FIG. 1 is the view of an example of the utilization of the rotatable or positioning single clamp claw-type clamp.

FIG. 13 is the view of an example of the utilization of the single clamp claw-type clamp having a rotatable central post and a positioning post, which is evolved from the the clamp structure as shown in FIG. 1, its difference with that in FIG. 1 is that a longer central post 1002 is provided on the place close to the motion clamp jaw 1004 end and on the bottom of the clamp base seat 1401, and a positioning post 1402 is provided close to the operational handle end.

FIG. 13-1 is its top view; FIG. 13-2 is its front view and FIG. 13-3 is its side cross sectional view.

Figure 14:
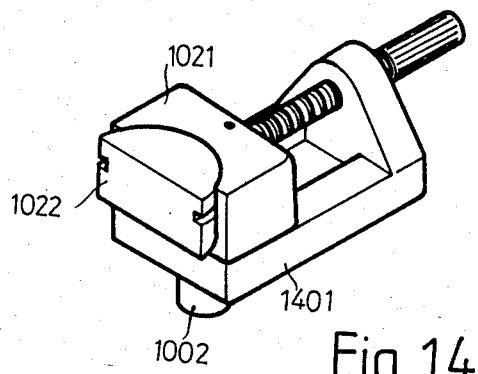
FIG. 14 is the view of the utilization of the clamp having a rotatable central post and a positioing post.
Figures 1, 14:
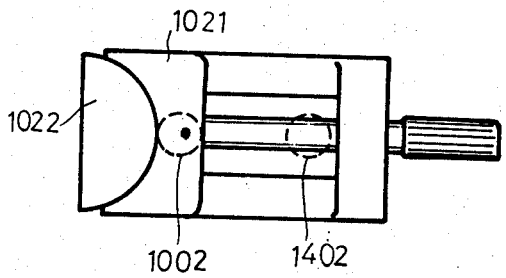
Figures 3, 14:
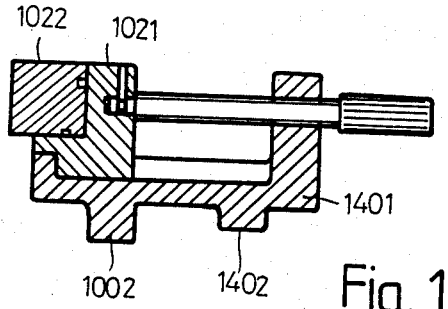
Figures 2, 14:
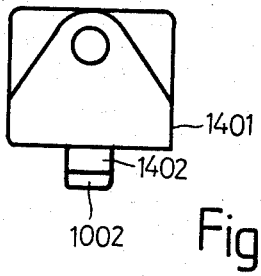

FIG. 14 is a version evolved from the clamp structure shown in FIG. 2, its difference with the clamp structure shown in FIG. 2 is that a longer central post 1002 is provided close to side of the semi-moon-shaped clamp claw 1022 and on the bottom of clamp base seat 1401 and that a shorter positioning post 1402 is provided lose to the operational handle side.

FIG. 14-1 is its top view; FIG. 14-2 is its front view, and FIG. 14-3 is its side cross sectional view.

Figure 15:
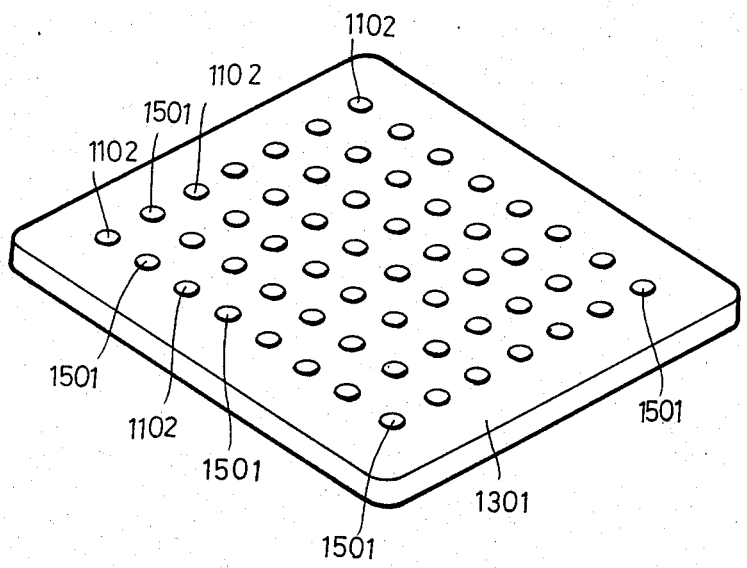
FIG. 15 is the view of the utilization of the work bench having rotatable holes and positioning holes.
Figures 1, 15:
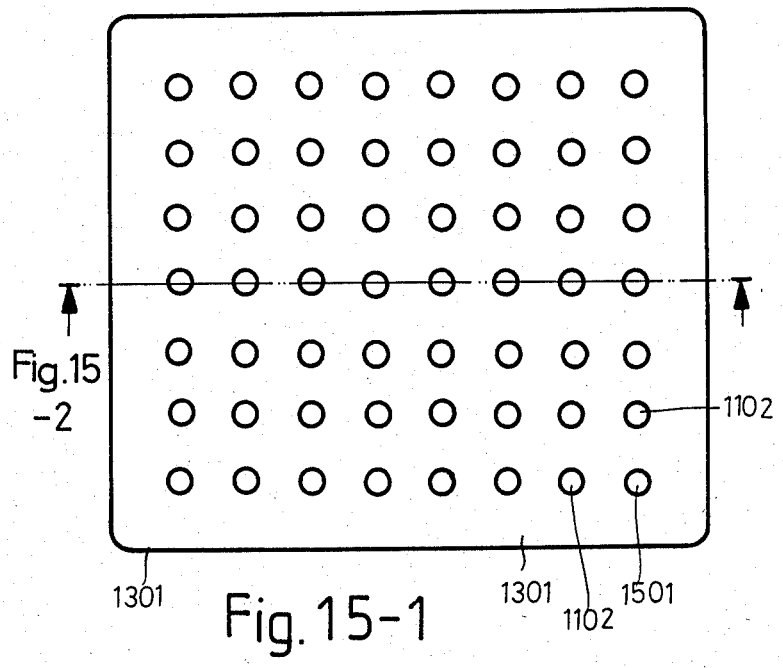
Figures 2, 15:
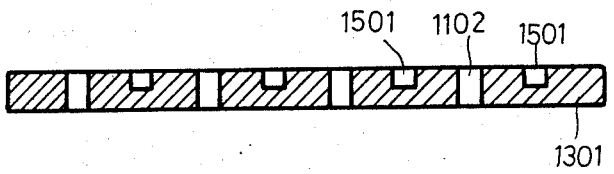

FIG. 15 is the view of an example of the utilization of the work bench having rotatable holes and positioning holes, and this is a work bench top matching the clamp structure as illustratted in FIGS. 13, 14 and is in a plane form similar to that shown in FIG. 10, and its structural features lie in that:

its bench top have regular and staggerly arrayed deep holes and shallow holes;

the distances between the holes is the same as that of the central post 1002 and positioning post 1402 of the clamp structure in FIGS. 13, 14 and couples them for clamp various work pieces;

the lengths difference between the long support leg and the short leg on the bottom of the clamp is larger than or equal to the depth of the shallow hole.

FIG. 15-1 is its top view; FIG. 15-2 is its side cross sectional view.

The work bench of the above-said clamp structure can be further constituted by a work bench with a ring-shaped slot 1602, and a number of clamp sets each having a central post 1002 respectively couple the above-said ring-shaped slot 1602 for adjustments in clamping directions or further making the work bench have multiple ring-shaped slots 1602 for selecting the larger distances, while the drive guide post is to make the clamping and small distance adjustments.

Figure 16:
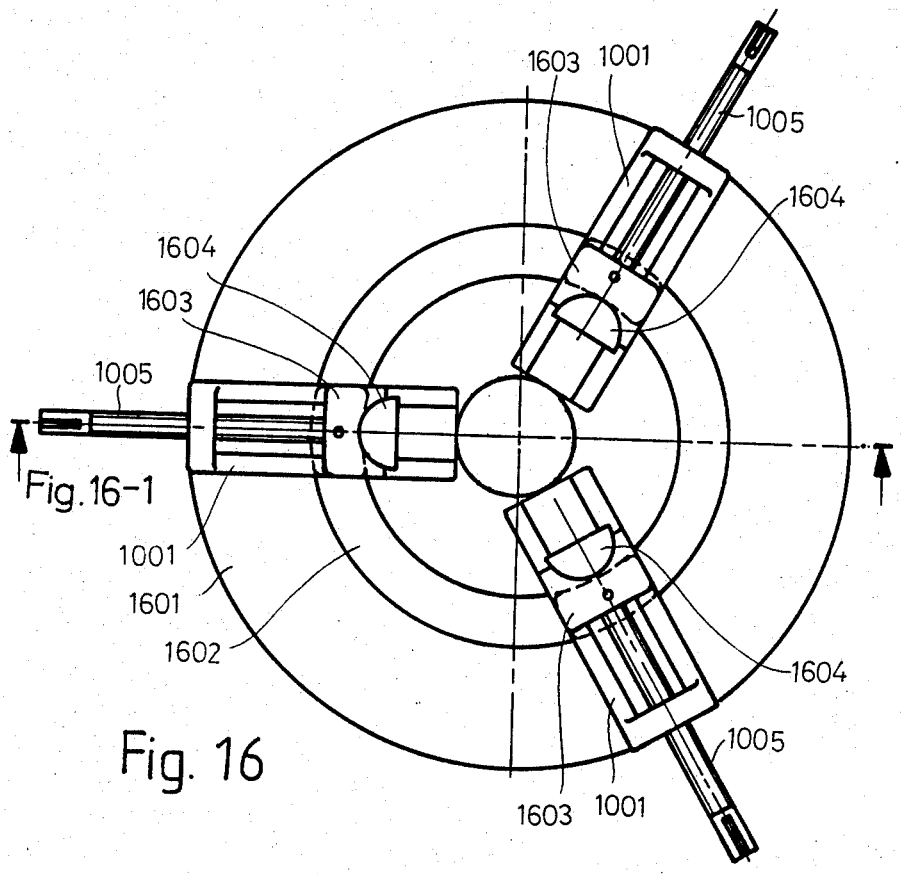
FIG. 16 is the view of an example of the utilization of the work bench having ring-shaped coupling slots.
Figures 1, 16:
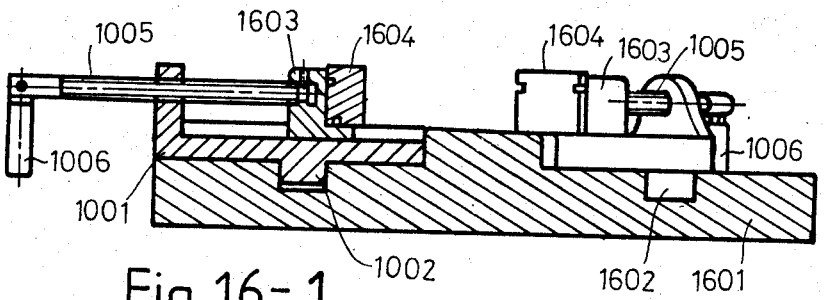

FIG. 16 is the view of an example of the utilization of the work bench having the ring-shaped coupling slots a parallel-type ring-shaped slot 1602 couples the central post 1002 of the clamp set for adjustments in the clamping directions, and its structural features are that:

the clamping sturcture with at least 3 sets of clamps or used in combination with the blocking blocks has, at least, a set of round posts with their bottoms protruding, while the disc-type machine seat has, at least, a section of segments of the arc structure or closed circular arc structure to couple the above-said round post for angular displacement adjustments;

the clmap motion jaws include those having the sliding clamp claw 1604;

the clamp motion jaws include those having non-motion (fixed) clamp claw having a fixed clamp face;

its middle part has a disc-shaped fixed bench, the height of which does not hinder the motion clamp claw and the jaw driving toward the middle part;

the coupling way of the above-said clamp structure and the machine seat is that a round post is provided on the bottom of the clamp structure to couple at least one set of the arc slots in the machine seat for sliding adjustments.

FIG. 16-1 is its side cross sectional view.

Figure 17:
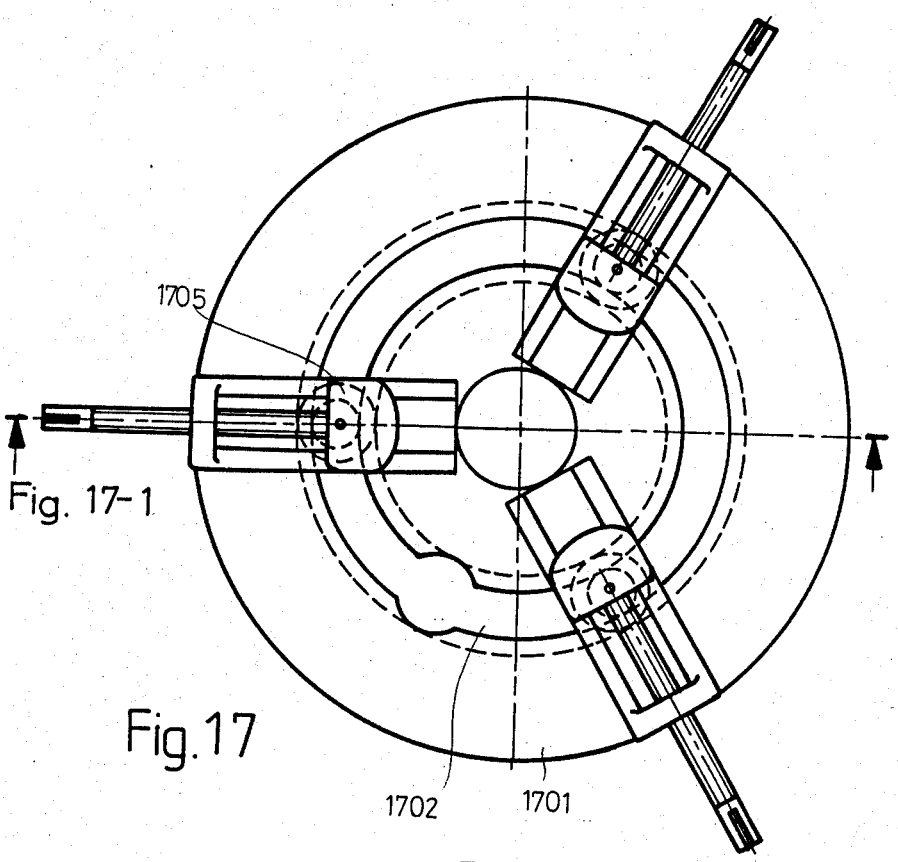
FIG. 17 is the view of an example of the utilization of the work bench having dovetail-type ring-shaped coupling slots.
Figures 1, 17:
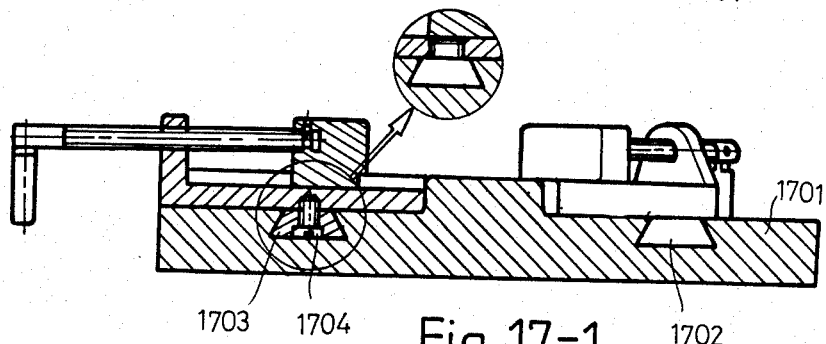

FIG. 17 is the view of an example of the utilization of the work bench having dove-tail-type ring-shaped coupling slot and indicates the structure illustrated in FIG. 16 to the effect that the support leg on the bottom of the clamp base seat further replaced by a conic coupling block 1703 and is locked by screw 1704 on the clamp bottom or the upper end of said screw 1704 has a threaded post to be directly screwed in a threaded hole in provided in the bottom of the clamp base seat; and the features of this structure lie in that:

the base seat 1701 has at least a dove tail ring-shaped slot 1702 which is in a tupered dovetail cross section with a bigger bottom and a smaller top, in which at least one place is provided with paralle round holes to accommodate the conic coupling block 1703 of the clamp;

the bottom of the clamp proper has a conic coupling block 1703 forming the support leg, the screw 1704 locks the clamp proper or the top of said screw 1704 has a threaded post to be directly screwed in and fixed on the bottom of the clamp.

When the above-said structure is used to clamp a work piece, the clamping direction can be adjusted according to the shapes of work pieces and properly employed in combination with the blocking blocks, and the number of clamps and blocking blocks can be properly added to accurately clamp the work pieces.

FIG. 17-1 is its side cross sectional view.

Figure 18:
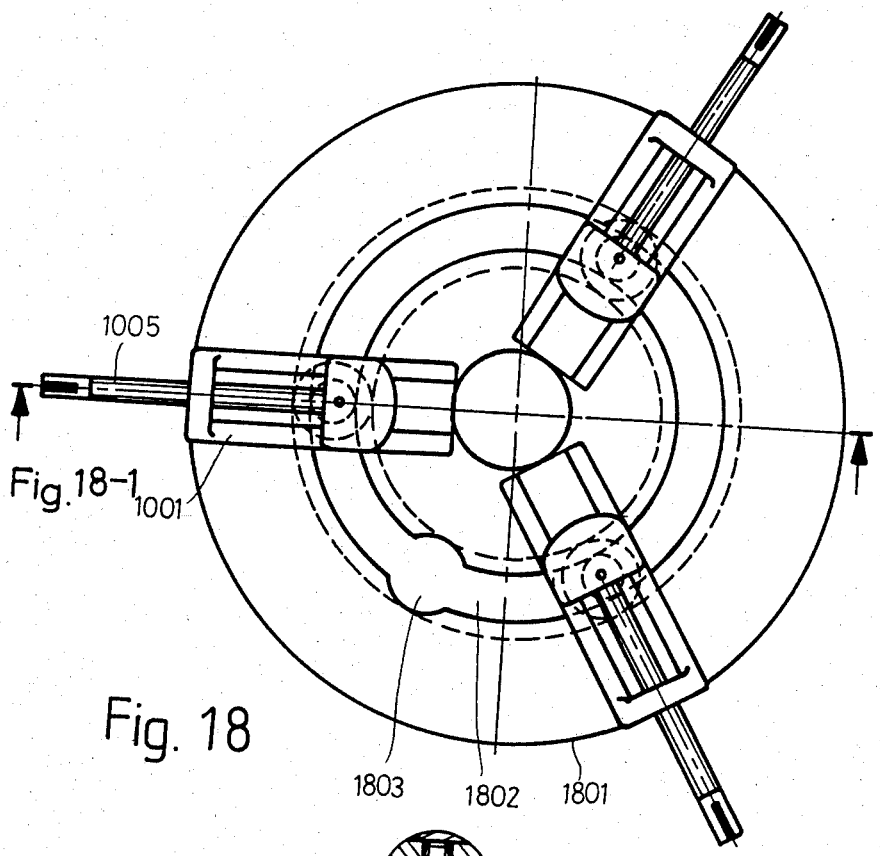
FIG. 18 is the view of an example of the utilization of the work bench having T-slot-typ ring-shaped coupling slots.
Figures 1, 18:
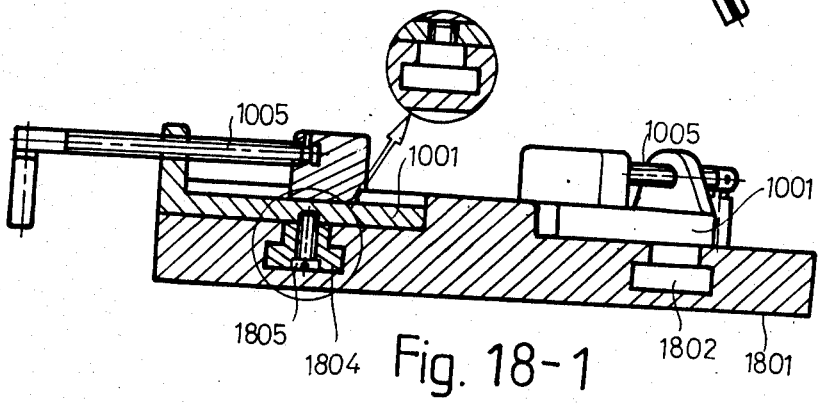

FIG. 18 is the view of an example of the utilization of the work bench having T-slot-type ring-shaped coupling slot and also the example of the utilization of the ring-shaped T-slot 1802 which is changed from the dovetail ring-shaped slot 1702 in FIG. 17. With the exception that the cross section of the slot is changed from the dovetail shape into the ⊥-shaped slot, and that the clamp or the support leg of the blocking block is changed to the way that the rabbeting slide block 1804 is locked, by the join screw 1805, on the clamp bottom or the end of said rabbeting slide block is in a helic form to be directly screwed in the clamp bottom, the principles of its remaining structure is same as of that shown in FIG. 17.

FIG. 18-1 is its side cross sectional view.

Figure 19:
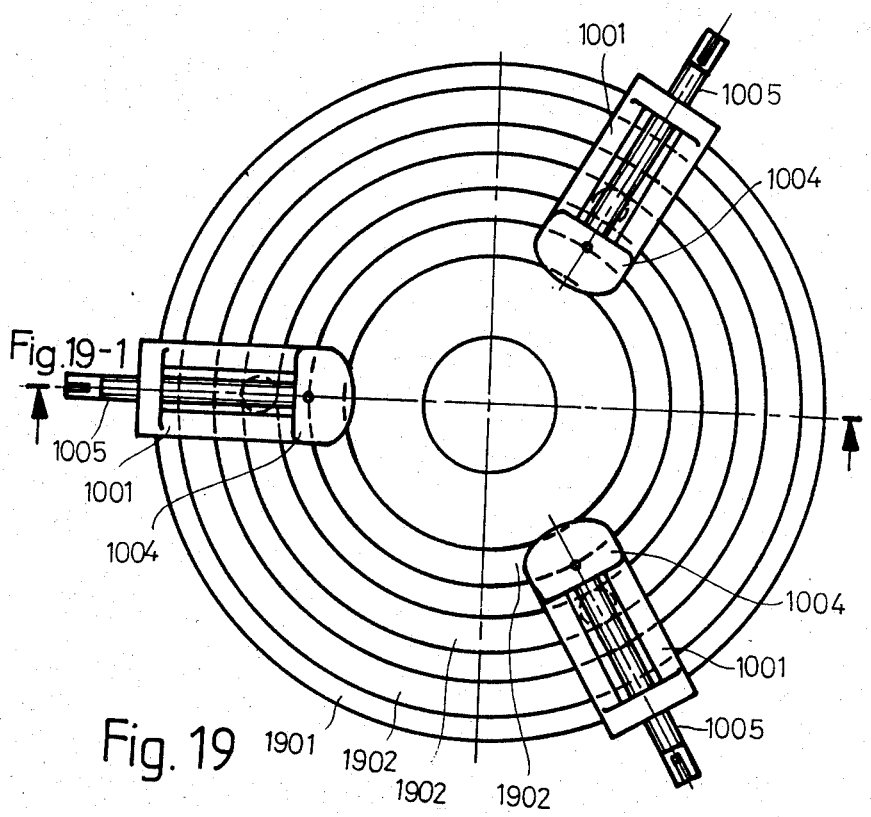
FIG. 19 is the view of an example of the utilization of the work bench having multi-ring-shaped coupling slots.
Figures 1, 19:
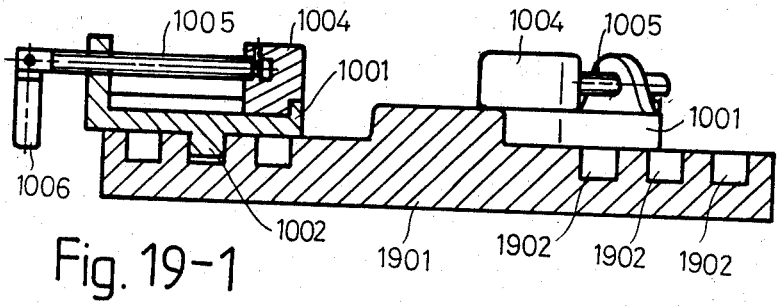

Besides, if it is desired to make a larger distance changes for the above-said structure in FIG. 16, it is a must for the design of the multi-ring-shaped slots 1902, as shown in FIG. 19 is an example of the utilization of the work bench having the multi-ring-shaped coupling slots, in which the ring-shaped slots 1902 are set in a multi-ring form, when it is desired to adjust the clamp or blocking block in larger distances, the clamp maybe directly removed and moved to another ring-shaped slot; the prinicples for its remaining structure is same as of the example of the utilization shawn in FIG. 16, so no repetitions of them is needed herein.

FIG. 19-1 is its side cross sectional view.

Besides, the principles for the multi-ring-shaped slots of the examples of the utilization shown in FIGS. 17, 18 are same as of the above-said examples of the utilization.

Figure 20:
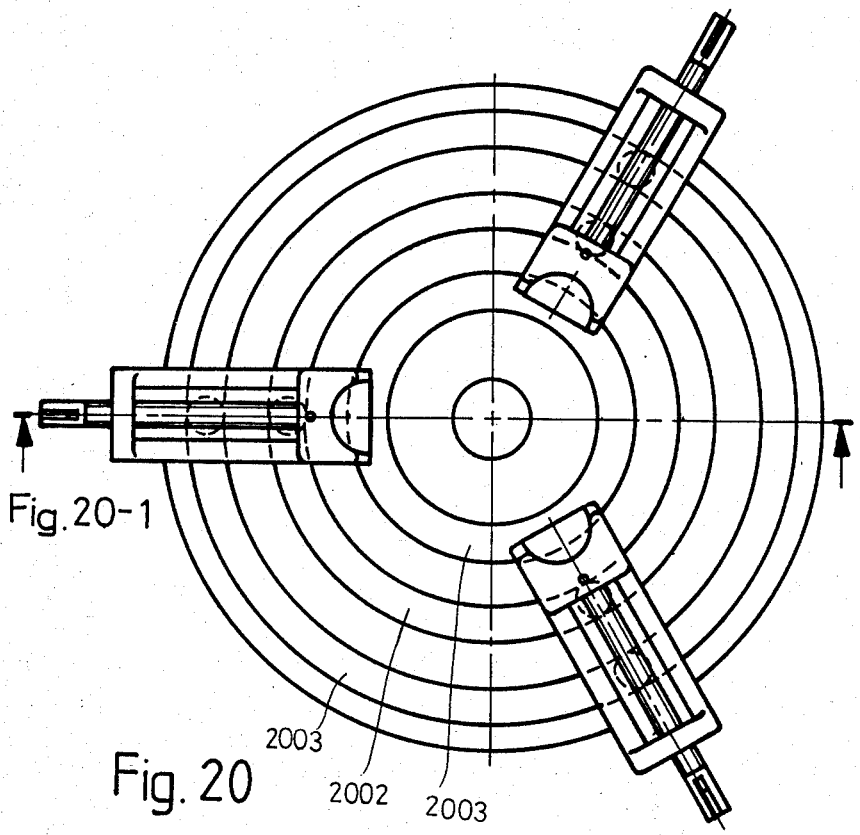
FIG. 20 is the view of an example of the utilization of the positioning work bench having multi-ring-shaped slots in different depths.
Figures 1, 20:
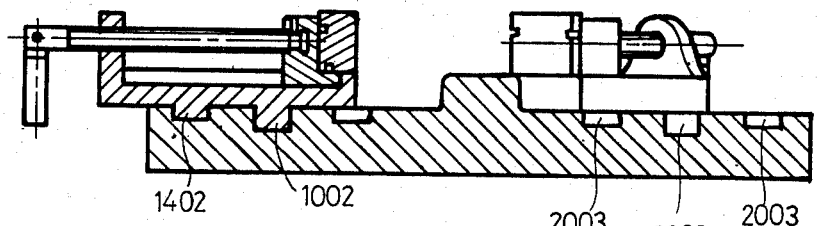

Additionally, the structure of the above-said multi-ring-shaped slots can further be set in a means with slots in different depths and a staggered form in order to combine and join the above-said clamp sets having support legs in different lengths, thus forming the optional swingable or locked functions of the clamp seats swingable or, FIG. 20 is the view of an example of the utilization of the work bench with a multiple of ring-shaped rings in different depths for positioning and its structural features lie in that:

the work bench has, at least, a set of the deeper ring-shaped slots 2002;

at least one shallower ring-shaped poritioning shallow slots 2003 are provided concentrically with deeper ring-shaped slots 2002;

the shallower widths of said deeper ring-shaped slots 2002 and the ring-shaped positioning slots 2003 are good enough to accommodate the clamp bottom;

the distance between the deeper ring-shaped slots 2002 the shallower ring-shaped slots is same as of the support legs on the clamp bottom;

the bottom of the clamp has a set of the longer support legs and the shorter support legs;

the lengths difference between the longer and the shorter support legs is larger than or equal to the depth of the ring-shaped positioning shallow slot 2003.

FIG. 20-1 is its side cross sectional biew.

Summing all the above up, in this case, the locking or rotatanle clamp structure forms selective multi-directional clamps and is further wed in combination with the blocking blocks and also employ the examples of the utilization of various mutually agreeable structures to achieve a design of practicality.

I claim:

1. A work bench, comprising a pair of spaced blocks, a support post received in each of the blocks for slidable movement therein along a substantially vertical axis, a horizontal work table supported on top of the posts, means for clamping the support posts to the respective blocks, whereby the height of the work table may be adjusted, each of the blocks having a pair of sockets therein, the sockets in each block being arranged in juxtaposition to the respective support post and extending downwardly, a pair of substantially U-shaped legs, each of the legs including a substantially horizontal bight portion adapted to rest on the floor, each of the legs further including a pair of substantially parallel leg portions connected with the bight portion and having free end portions received in the respective sockets, and wherein the work table has a top surface and further has a bottom surface, a plurality of bosses formed integrally with the work table and depending from the bottom surface thereof, each of the bosses having a through aperture formed therein and extending from the top surface to the bottom surface of the work table, the apertures being distributed substantially throughout the work table, and respective ribs connecting adjacent bosses, thereby providing strength and rigidity to the work table during use of the work bench.

2. The work bench of claim 1, further including supporting struts connecting the respective leg portions of opposing U-shaped legs.

3. The work bench of claim 1, further including an apron depending vertically from one end of the work table beyond the respective leg.

4. The work bench of claim 1, wherein at least one clamp is associated with a selected one of the apertures, the clamp comprising a foot rotatably received in the respective aperture, an upstanding bracket formed integrally with the foot, a rod threadably received on the bracket, and a clamping jaw carried by the rod and slidably mounted on the bracket for limited movement relative thereto.

5. The work bench of claim 1, wherein the sockets diverge downwardly and outwardly of each block, such that the legs are splayed downwardly and outwardly relative to the work table.

6. The work bench of claim 1, wherein each of the support blocks comprises an angle piece having respective horizontal and vertical wall portions, the vertical wall portion having a boss for slidably receiving the respective support post, the boss being disposed substantially between the sockets, and wherein the work table has a pair of guide posts depending downwardly therefrom, and the horizontal wall portion of the angle piece has respective openings to receive the guide posts, thereby providing for improved stability of the work table on the support blocks.

7. In a work bench including a work table having a top surface and a bottom surface, the work table being substantially rectangular in plan outline and having respective substantially parallel side edges, the combination of respective sets of vertical parallel posts carried by the bottom surface of the work table, depending therefrom, and spaced inwardly from the respective side edges of the work table, a support block means for each set of posts and having openings formed therein for slidably receiving the respective posts, thereby facilitating a vertical height adjustment of the work table relative to the support block means, means for clamping at least one post in a respective set of posts to its respective support block means at a desired adjusted vertical position, leg means carried by the support block means, respectively, a plurality of bosses formed integrally with the work table and depending from the bottom surface thereof, each of the bosses having a through aperture formed therein and extending from the top surface to the bottom surface of the work table, wherein at least one clamping element is adapted to be received within a selected aperture in the work table, the bosses being distributed substantially throughout the work table, thereby providing a multitude of respective apertures for substantially increased versatility and flexibility in the use of the work bench, and respective ribs connecting adjacent bosses, thereby providing for increased strength and rigidity.

* * * * *